United States Patent [19]

Robinson

[11] Patent Number: 4,867,446

[45] Date of Patent: Sep. 19, 1989

[54] CUE TIP CHALK RETENTION SYSTEM

[76] Inventor: John E. Robinson, 1702 Shoreline Dr., Santa Barbara, Calif. 93109

[21] Appl. No.: 272,451

[22] Filed: Nov. 17, 1988

[51] Int. Cl.[4] ..... B27L 9/00

[52] U.S. Cl. ..... 30/494; 30/366

[58] Field of Search ..... 30/494, 366–368, 30/361, 358; 51/204

[56] References Cited

U.S. PATENT DOCUMENTS

| | | | |
|---|---|---|---|
| 221,164 | 11/1879 | Fautz . | |
| 284,548 | 9/1883 | Gwyn . | |
| 546,121 | 9/1895 | McIntire | 30/494 |
| 551,195 | 12/1895 | Olney | 30/494 |
| 955,819 | 4/1910 | Mahoney | 30/494 |
| 1,259,136 | 3/1918 | Rogers . | |
| 1,534,975 | 4/1925 | Lindfors | 30/494 |
| 2,072,484 | 3/1937 | Nyhagen | 273/70 |
| 2,577,995 | 12/1951 | Bozgrth . | |
| 3,047,950 | 8/1962 | Stasiuk | 30/368 |
| 3,728,828 | 4/1973 | Freedman | 51/204 |
| 3,769,760 | 11/1973 | Kritske | 51/204 |
| 3,989,079 | 11/1976 | Treadway | 30/494 |
| 4,594,782 | 6/1986 | Willard | 30/494 |
| 4,785,586 | 11/1988 | Kratfel | 30/494 |

*Primary Examiner*—Douglas D. Watts
*Attorney, Agent, or Firm*—Kenneth J. Hovet

[57] ABSTRACT

A cue tip chalk retention system wherein openings are formed on cue tip surfaces and chalk is rubbed into the openings. The openings are formed with a penetrating device comprising a housing with a cavity containing multiple outwardly extending pin members. The pin members have a base portion secured to the cavity lower region and a free end portion located in the cavity upper region. The free end portion includes an exposed pointed end which is used to cleanly penetrate the cue tip surfaces and form the desired chalk retention openings.

17 Claims, 1 Drawing Sheet

CUE TIP CHALK RETENTION SYSTEM

BACKGROUND OF THE INVENTION

1. Field of the Invention

The invention relates to the tip of a pool or billiard cue and, more particularly, to a system for enhancing the effectiveness of a cue tip during use.

2. Description of the Prior Art

There are numerous implements described in the prior art for smoothing, roughing and shaping the tip of a cue. A majority of such devices utilize some type of abrasive material such as the carbide scuffer of 4,594,782; the grinding wheel of 3,728,828 and the emery cloth of 3,989,079. Other means may also be used such as the file disk and collar of 1,259,13f6 and the scraper blades of 1,534,975. These implements have particular application for trimming the periphery of a tip and shaping its surface. Several devices also utilize cutting means for maintaining the convex shape of a cue tip. Representative patents illustrating these devices are 546,121; 551,195; 955,819 and 2,577,995.

Upon considering the above devices, it becomes apparent they all operate by removing portions of the cue tip. As such, in a relatively short period of time, the loss of material will require replacement of the cue tip. This is particularly true with abrading devices intended for use during game play. It is not uncommon for a player to dress and chalk the cue tip before each shot. In such cases, the tip becomes thin and useless in a very short period of time.

With respect to the above circumstances, devices shown in 221,164; 3,769,760 and 4,594,782 are specially designed to scuff a cue tip and permit better chalk retention during the course of a game. In addition to tip wear, problems inherent with the above devices are illustrated in FIG. 6 of the drawings of the present case. An enlarged view of a cue tip 10 is shown having a napped surface 11 formed by any of the aforementioned devices. The enlarged view reveals bits of abrasive 12 embedded in the surface and irregular shreds of fiber 13 formed by the tearing action of the abrading devices.

Undoubtedly, the bits of abrasive will scratch the cue ball and may contribute to miscues. The fiber shreds operate to actually loosen chalk after it is rubbed on the cue tip surface. They also detract from having a uniformly shaped cue tip. Of course, FIG. 6 does not show the loss of material that occurs every time one of the aforementioned prior art devices is used.

SUMMARY OF THE INVENTION

The present invention provides a system for improving chalk retention on a cue tip without wearing down, tearing or otherwise distorting the cue tip surface. A penetrating device is provided comprising a receptacle containing outwardly directed pin members. The pin members comprise elongated shafts having a base portion which merges into a tapered free end portion. The end portion is located in an upper region of the receptacle and terminates at a pointed end.

The receptacle may consist of a housing with an interior cavity for retaining the pins in an upright manner. The cavity includes a bottom wall which supports the pin member base portion and interior sidewalls which constrain the pins in uniform or random arrangements.

In use, the pointed ends are pressed axially against the cue tip with sufficient force to puncture the surface and form small openings. No torsional forces are used to avoid shredding or abrading. The openings are subsequently filled by rubbing a cue tip chalk cube thereover. The openings function as storage means for long-lasting chalk retention and the cue tip curvature is not distorted or disturbed in any way.

DESCRIPTION OF THE PREFERRED EMBODIMENTS

Figure 2:
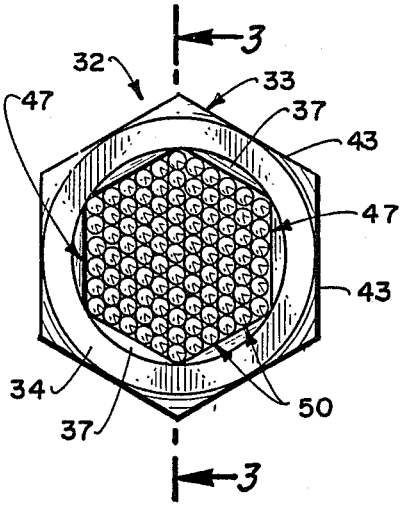
FIG. 2 is an enlarged top plan view of the penetrating implement of FIG. 1 showing pin members in alignment.
Figure 3:
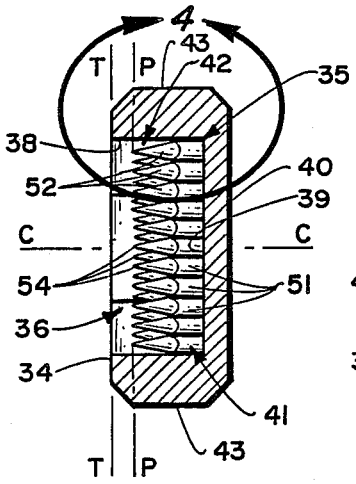
FIG. 3 is a cross-sectional view taken along lines 3—3 of FIG. 2.
Figure 4:
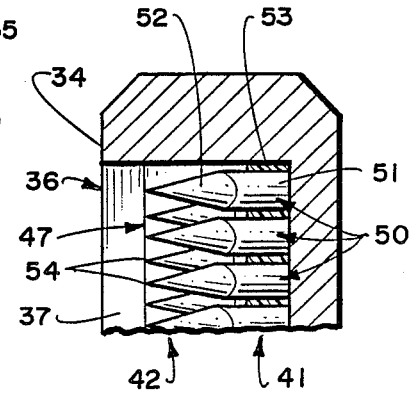
FIG. 4 is an enlarged fragmentary cross-sectional view taken along line 4—4 of FIG. 2.

The penetrating device 30 of the invention may be described with particular reference to FIGS. 2–4 of the drawings. The device comprises a receptacle 32 for holding a plurality of outwardly directed pin members 50. As shown, the receptacle comprises a housing 33 having a top surface 34 and a bottom surface 40. Both surfaces are interconnected by exterior walls 43. The height and shape of the exterior walls are shown as hexagonal but may be other shapes as dictated by design aesthetics.

A cavity 35 is formed in the housing top surface. This creates a cue tip opening 36 which defines an imaginary top plane T,T, For convenience, the inner edge 37 of the tip opening can be beveled to facilitate insertion of a cue tip.

The housing may be constructed of a solid block-like material of metal, plastic, ceramic or wood. In such case, cavity 35 may simply be an area drilled out of the block top surface. Preferably, the housing is pocket-sized and adapted for easy manual grasping.

Figure 5:
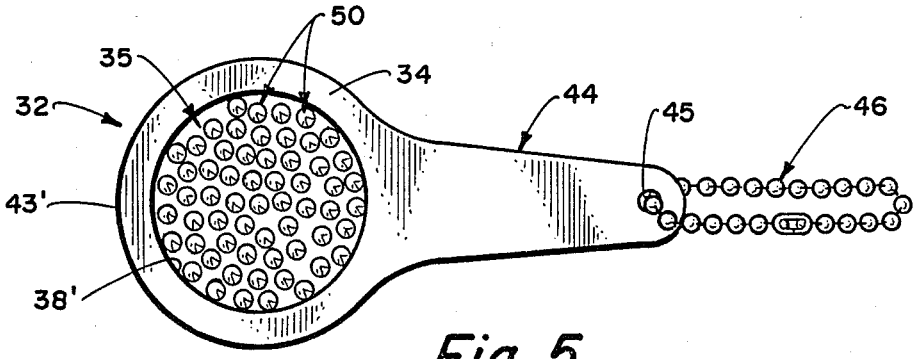
FIG. 5 is a top plan view of an alternative embodiment of the implement which also illustrates pin members in a random arrangement.
Figure 6:
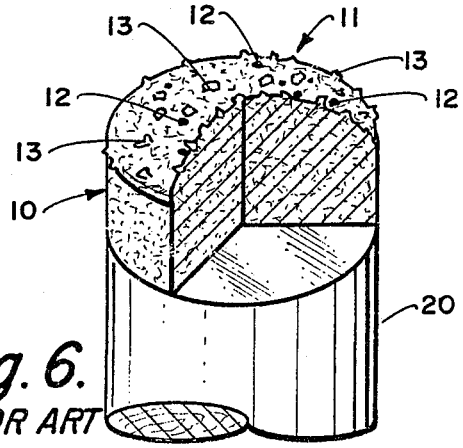
Fig. 6. PRIOR ART
FIG. 6 is an isometric view of a cue tip which has been abraded with a prior art device.

To further enhance manipulation of the device, the housing may include a handle means. As shown in FIG. 5, this comprises an arm 44 extending from the side of the housing. The arm may taper outwardly to a distal end having an aperture 45 for key chain 46.

The cavity shown in FIGS. 2–4 has a hexagonal cross-section with interior sidewalls 38 extending upwardly from a bottom wall 39. In FIG. 5, the interior sidewalls 38' are circular and the cavity is shaped as a right circular cylinder. In both cases, the bottom wall 39 is preferably flat and parallel with top plane T,T, Also, both cavity shapes include a central axis c,c for defining a reference point of symmetry. For descriptive purposes, the cavity interior may be divided into about halves comprising a lower region 41 and an upper region 42.

Sidewalls 38,38' preferably extend perpendicularly from the bottom wall. Their height should not be less than the length of pin members 50. This is to avoid the hazard of having exposed pin points, although it's conceivable the housing could include a domed cover for extra long projecting points.

The pin members each comprise an elongated rigid shaft having a base portion 51 which merges into a pointed end portion 52. The base portion is supported by the cavity bottom wall and is shown as having a round cross-sectional shape. However, it could be polygonal in cross-section to facilitate a uniform side-by-side straight alignment as shown in FIG. 2.

The pointed end portion can also have a round or polygonal cross-section that terminates in a sharp point. As shown, it comprises an inverted cone shape having a central apex defining the pin member terminus 54. With the base portion secured to the cavity lower region, the pointed end portion may be characterized as a free end portion extending into the cavity upper region.

It is desirable that the terminus or end point of each member be coextensively located in a level manner to define a point plane P.P. The point plane may be parallel with bottom wall 39 and should be proximate top plane P.P. In such case, and provided the base portions extend from the bottom wall, the pin members may each have an equal length. Particularly with the uniform alignment of FIG. 2, it is also convenient for each pin member to have a substantially similar shape.

As best shown in FIGS. 2–4, the pin members are located adjacent to each other in an upright lengthwise disposition with the longitudinal axis of each member parallel with central axis c,c. The free end portions extend outwardly from the cavity and terminate at point plane p, p which is offset beow top plane T,T. The point plane is in the upper region 42 of the cavity and may coincide with the transition line 47 between sidewall 38 and bevel 37. This facilitates guidance of cue tip 10 towards the pin member end points.

With reference to FIG. 5, a modified housing is shown having rounded exterior walls 43' and a circular cavity wall 38'. A tapered arm 44 extends transversely from the exterior wall as hereinabove described. The same arrangement and type of pin member may be used as described with reference to FIGS. 2—4. However, as shown in this embodiment, fewer pin members are used and they are randomly distributed. In all other respects, the cavity and cooperating pin member orientation are as described in FIGS. 2–4.

Figure 1:
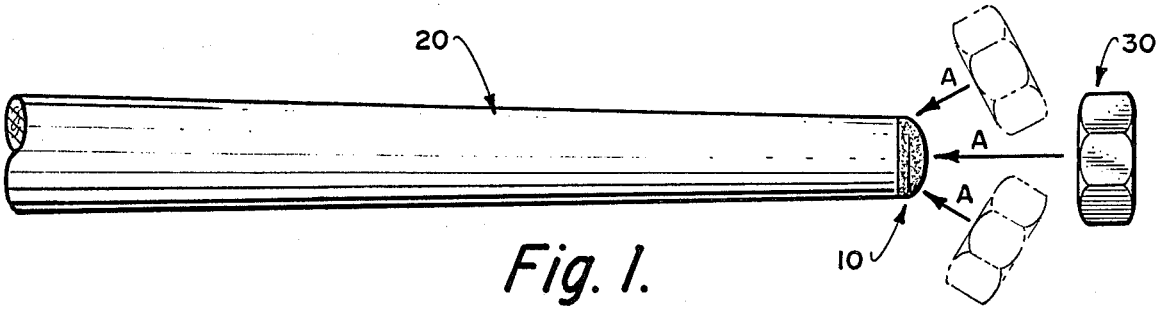
FIG. 1 is a side elevational view illustrating use of the pentrating implement of the invention with a conventional cue and cue tip.
Figure 7:
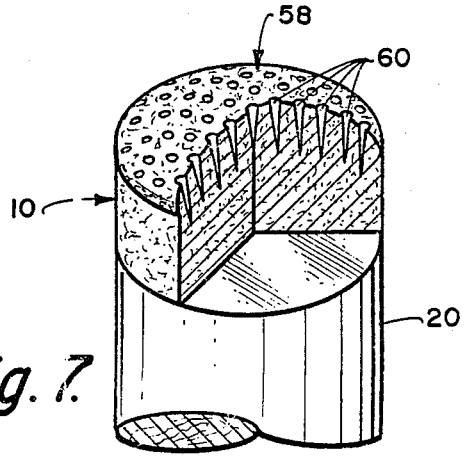
FIG. 7 is an isometric view of a cue tip that has been treated with the penetrating implement of the invention in the manner depicted in FIG. 1.

In operation, a user will grasp the housing and direct the pin member pointed ends against the cue tip surface 58 as depicted by arrows A in FIG. 1. Force should be exerted sufficient to penetrate the fibrous cue tip material and form substantially uniform chalk openings 60 as illustrated in FIG. 7. Such openings will generally correspond to the shape of end portion 52. The puncturing force should be straight into, and out of, the cue tip without torque or twisting. As desired, the above process may be repeated against selected portions, or all, of the cue tip surface.

As referenced herein, the fibrous cue tip material is most commonly constructed of leather which is readily pierceable by the pin member pointed ends. The cue tips are usually glued to the narrow end of a cue and are replaceable.

After the chalk openings have beenformed, cue tip chalk will be rubbed over the perforated surface 58. The chalk powder will enter the chalk openings and be retained therein—even after numerous impacts between the cue tip and cue ball.

Since the invention permits a user to select certain areas of the cue tip for penetration, an extra advantage arises in improving the ability of a good player to impart a particular rotational movement to the cue ball. Further, the penetrating device does not shred, tear, distort or wear down the cue tip surface in any way. In fact, it may slightly expand the surface and improve cue tip resiliency.

While the invention has been described with respect to preferred embodiments, it can be seen by those skilled in the art that various modifications may be made without departing from the scope and spirit of the invention. Accordingly, it will be understood that the invention is not to be limited by the specific embodiments hereinabove described, but only by the scope of the appended claims.

I claim:

1. A device for penetrating a cue tip comprising:

a housing with a top surface having a cavity formed in said top surface defining a cue tip opening; and, multiple upright pin members secured within said cavity with each member having a pointed end portion directed outwardly from said cavity and a terminus proximate said cue tip opening.

2. The device of claim 1 wherein said cue tip opening defines a top plane wherein said terminus does not extend past said plane.

3. The device of claim 1 wherein eachpin member comprises an elongated shaft arranged lengthwise in said cavity.

4. The device of claim 3 wherein each pin member has about the same length.

5. The device of claim 3 wherein each pin member includes a base portion and said cavity includes a bottom wall that supports each base portion.

6. The device of claim 2 wherein said cavity has an upper region and a lower region, said terminus being located in a point plane within said upper region below said top plane.

7. The device of claim 6 wherein said point plane and said top plane are parallel.

8. The device of claim 1, wherein each of said upright members has a substantially similar shape and is positioned in a side-by-side relationship within said cavity.

9. An implement for puncturing a cue tip to form chalk openings comprising:

a receptacle with a plurality of pin members arranged lengthwise in said receptacle, said pin members having a base portion secured to said receptacle and a pointed free end portion directed outwardly from said receptacle, said receptacle having a cue tip opening devining a top plane with said free end portion terminating proximate said top plane.

10. The implement of claim 9 wherein said pin members comprise elongated shafts arranged parallel to each other in said receptacle.

11. The implement of claim 10 wherein said receptacle includes a bottom wall which is parallel to said top plane with sidewalls extending about perpendicularly from said bottom wall, said shafts extending about parallel with said sidewalls.

12. The implement of claim 11 wherein said shafts have about equal length and said base portions are supported by said bottom wall.

13. The implement of claim 11 wherein said shafts have a substantially similar shape.

14. The implement of claim 13 wherein said shafts are randomly distributed in said receptacle.

15. The implement of claim 9 wherein said receptacle includes a handle means for manually grasping said implement.

16. A method for retaining chalk on the surface of a cue tip comprising:

(a) providing an implement containing a plurality of pin members having exposed pointed ends;

(b) moving said implement adjacent said cue tip with said pointed ends in contact with a predetermined portion of said cue tip;

(c) forcing said pointed ends straight through said surface;

(d) withdrawing said pointed ends straight outwardly from said surface; and, (e) rubbing chalk over said surface.

17. The method of claim 16 wherein steps b, c and d are repeated over selected areas of said surface prior to step e.

* * * * *